United States Patent [19]

Hanks

[11] Patent Number: 5,058,211

[45] Date of Patent: Oct. 22, 1991

[54] BANDANNA-TYPE ARTICLE OF WEARING APPAREL

[76] Inventor: Darrell L. Hanks, 5718 Purdue, Amarillo, Tex. 79109

[21] Appl. No.: 600,694

[22] Filed: Oct. 22, 1990

[51] Int. Cl.[5] ..... A41D 23/00

[52] U.S. Cl. ..... 2/206; 2/91; 2/171; 2/DIG. 11; 2/207

[58] Field of Search ..... 2/171, 172, 173, 174, 2/206, 207, DIG. 11, 91

[56] References Cited

U.S. PATENT DOCUMENTS

| | | | |
|---|---|---|---|
| 1,327,062 | 1/1920 | Quinn | 2/91 |
| 2,160,567 | 5/1939 | Sterne | 2/171 |
| 2,385,791 | 10/1945 | Bye | 2/91 |
| 2,600,814 | 12/1952 | Tomarkin | 2/207 |
| 2,939,150 | 6/1960 | Rosenthal | 2/91 |
| 3,105,970 | 10/1963 | Herzberg | 2/91 |
| 3,260,292 | 7/1966 | Costello | 2/207 X |
| 3,618,140 | 11/1971 | Goldfarb | 2/207 |
| 3,935,597 | 2/1976 | Frechmann et al. | 2/207 |
| 4,718,123 | 1/1988 | Petropoulos | 2/91 |
| 4,862,518 | 9/1989 | Williams et al. | 2/49 R |

FOREIGN PATENT DOCUMENTS

| | | | |
|---|---|---|---|
| 2457287 | 12/1974 | Fed. Rep. of Germany | 2/207 |
| 833431 | 6/1956 | United Kingdom | 2/207 |

*Primary Examiner*—Werner H. Schroeder
*Assistant Examiner*—Jeanette E. Chapman
*Attorney, Agent, or Firm*—Norman B. Rainer

[57] ABSTRACT

A bandanna-type article of wearing apparel is fabricated from an integral piece of fabric folded in a manner to have forward and back panels of substantially triangular shape and an intervening pocket region. The configuration of the article is such that its upper edge is essentially the base of a triangle, and a downwardly directed apex constitutes the lower extremity of the forward panel. Tying ears extend from both extremities of the upper edge. A sheet of compliant thermally insulative material such as a polyurethane sponge is held by sewn seams within the pocket region.

6 Claims, 2 Drawing Sheets

BANDANNA-TYPE ARTICLE OF WEARING APPAREL

BACKGROUND OF THE INVENTION

1. Field of the Invention

This invention relates to an article of wearing apparel, and more particularly concerns a bandanna-type product which may be used to shield the wearer's face and neck from cold wind, sunlight and dust.

2. Description of the Prior Art

Conventional handkerchief scarfs, commonly called bandannas, in the usual form of squares or rectangles, are formed from thin fabrics of silk, cotton, rayon or the like which may be characterized as being of a limp and thin nature. Such bandannas are often used as a facial covering to protect the wearer's face from cold and wind and to filter dust out of inhaled air. However, due to the thin nature of the material, the bandanna provides very little insulating quality in cold temperatures, and little barrier in strong winds.

Furthermore, such bandannas have little or no stiffness and, when used as a facial protective covering, do not lend themselves to draping or shaping of the fabric to the face and neck. With the end portions of the bandanna used for tying purposes, the bandanna must closely conform to the face of the wearer and cannot be shaped to the face of a particular wearer. Strong winds often cause a conventional bandanna to be blown away from its most effective position.

Accordingly, it is an object of the present invention to provide a cloth wearing apparel article improved with respect to protecting the wearer's face and neck against exposure to weather elements.

It is another object of this invention to provide a bandanna-type wearing apparel article of the aforesaid nature formed from a limp fabric yet capable of resisting displacement in strong winds.

It is a further object of this invention to provide a wearing apparel article of the aforesaid nature which can be worn in different ways for protection of the face, head or neck from the effects of weather elements.

It is yet another object of the present invention to provide a wearing apparel article of the aforesaid nature of simple construction and amenable to economical manufacture.

These objects and other objects and advantages of the invention will be apparent from the following description.

SUMMARY OF THE INVENTION

The above and other beneficial objects and advantages are accomplished in accordance with the present invention by a bandanna-type article of wearing apparel comprising:

a) an integral piece of fabric having:

1) a forward panel of substantially triangular shape having front and rear surfaces, convergent side edges that meet in a downwardly directed apex, and a substantially straight base edge having opposed extremities that meet said side edges to form lateral apices, said base edge disposed opposite said downwardly directed apex in a manner causing said forward panel to have a line of symmetry that intersects said downwardly directed apex and perpendicularly bisects said base edge, 2) a back panel disposed upon the rear surface of said forward panel adjacent said base edge and formed as a continuous integral extension of said forward panel by virtue of the rearward folding of said piece of fabric, said back panel being disposed in parallel relationship to said forward panel and defining therewith a pocket region, and 3) elongated tying ears outwardly emergent from said lateral apices as continuous integral extensions of said forward panel and formed by the gathering and sewing of said piece of fabric, and b) a sheet of compliant thermally insulative material disposed within said pocket region and elongated upon a center axis parallel to said base edge and intersecting said lateral apices.

In preferred embodiments of the invention, the thermally insulative material is of rectangular configuration and is sewn within the pocket region by stitching that penetrates forward and back panels and the intervening insulative material.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
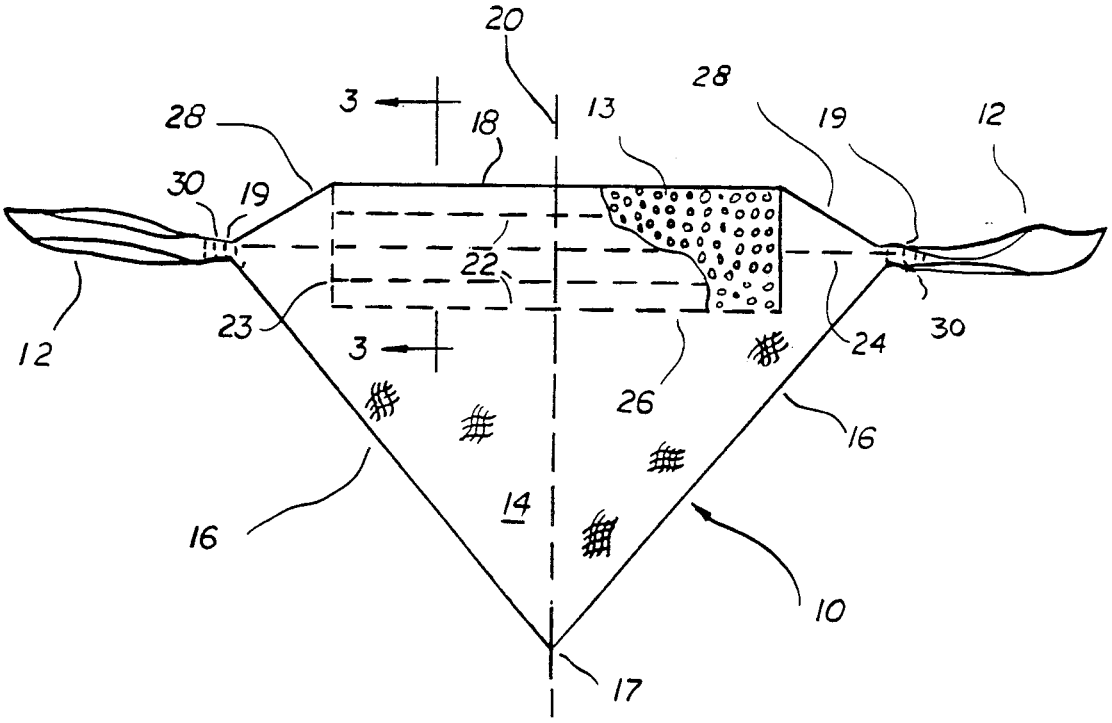
FIG. 1 is a front view of an embodiment of the bandanna-type article of the present invention.
Figure 2:
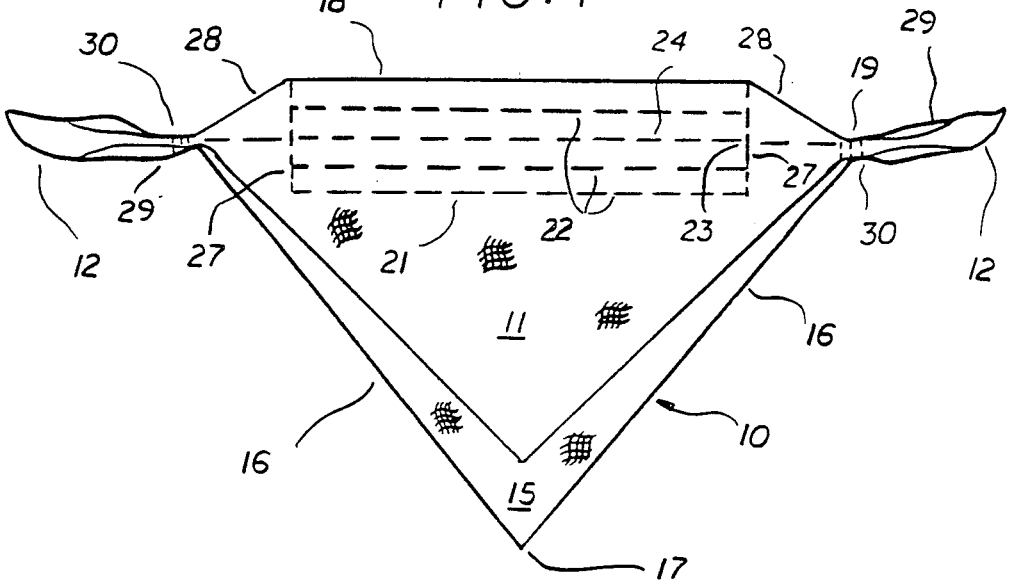
FIG. 2 is a rear view of the embodiment of FIG. 1.
Figure 3:
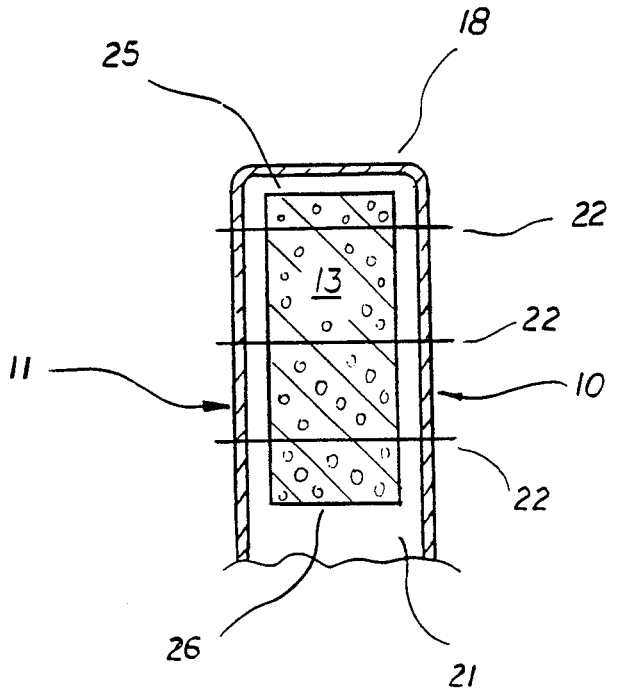
FIG. 3 is an enlarged sectional view taken upon the line 3—3 of FIG. 1.

Referring to FIGS. 1–4, a bandanna embodiment of the wearing apparel article of this invention is shown comprised of forward panel 10, back panel 11, tying ears 12 outwardly emergent from said panels, and a sheet of compliant insulative material 13 disposed between said panels.

The bandanna is made from a single piece of fabric, preferable of initially square shape and preferably woven of hydrophilic fiber such as cotton, silk or rayon. Such hydrophilic fibers enhance transmission of moisture, thereby minimizing perspiration accumulation on the wearer. Suitable fabrics are preferably of plain weave construction such as gingham, percale, and shantung types of fabric. The initially square piece of fabric may typically have an edge length between about 18 and 30 inches. The edges of the fabric preferably have a sewn hem or equivalent treatment to prevent unravelling.

Forward panel 10 is of substantially triangular shape, having front and rear surfaces, 14 and 15, respectively and convergent side edges 16 that meet in a downwardly directed apex 17. Forward panel 10 is further bounded by substantially straight base edge 18 having opposed extremities that meet with side edges to form lateral apices 19. Base edge 18 is disposed opposite apex 17 in a manner causing said forward panel to have a line of symmetry 20 that intersects apex 17 and perpendicularly bisects base edge 18.

Back panel 11 is disposed upon rear surface 15 of said forward panel, and is formed by the folding of the initial square piece of fabric rearwardly about a fold line that constitutes base edge 18. Accordingly, back panel 11 is a continuous integral extension of said forward panel, and has a triangular shape. A pocket region 21 is defined by base edge 18 and said panels. It is important to note that base edge 18 is formed above the true diagonal line that would be produced by the symmetrical folding of a square piece of fabric. Accordingly, short angled edges 28 extend between base edge 18 and lateral apices 19.

The sheet of thermally insulative material 13 is held within pocket region 21 by lateral lines of sewing 22 and transverse lines of sewing 23, said lines of sewing penetrating both panels. The illustrated insulative material has a rectangular shape elongated upon a center axis 24 that is parallel to base edge 18 and intersects lateral apices 19. The rectangular shape of the insulative sheet is comprised of upper long edge 25 disposed in contact with base edge 18, lower long edge 26, and end edges 27. It is to be noted that, in the illustrated embodiment, end edges 27 are inwardly disposed from the lateral apices. Such spacing is an important feature of the invention because it enables the bandanna to be properly conformed during use.

The insulative material is preferably comprised of a sheet of cellular foam made of polyurethane, neoprene or equivalent resilient polymers. In certain applications of the bandanna, closed cell foams are preferably to open celled foams. By virtue of the sheet of insulative material, and other features of construction, the bandanna can maintain a secure position when worn.

Elongated tying ears 12 are outwardly emergent from lateral apices 19 as continuous integral extensions of the piece of fabric, and are formed by gathering of the fabric along lines 29 and sewing along holding lines 30. Because the tying ears are emergent from the center axis 24 of the insulative material, the position of the bandanna is highly stable when worn. If instead, the tying ears were emergent from either the upper or lower long edges of the insulative material, the positional stability of the bandanna would be lessened.

Figure 4:
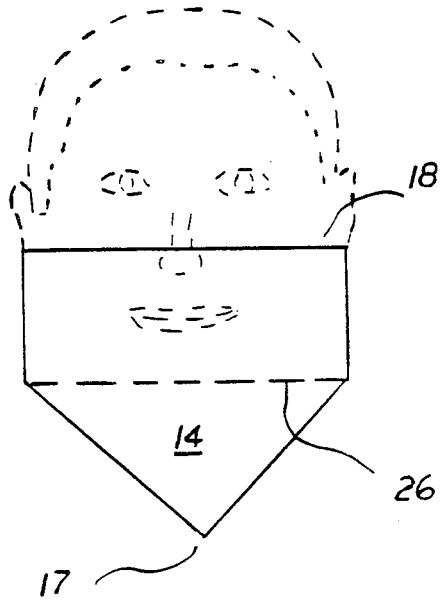
FIG. 4 is a front view of the embodiment of FIG. 1 shown in a wearing position adapted to protect the face of the wearer.

FIG. 4 shows the bandanna worn in a preferred manner wherein the insulative material covers the mouth and nose of the wearer, and the tying ears are knotted behind the head. Such mode of use protects against the breathing of extremely cold air.

Still further modes of wear of the bandanna are possible.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A bandanna-type article of wearing apparel comprising:

a) an integral piece of fabric having:

1) a forward panel of substantially triangular shape having front and rear surfaces, convergent side edges that meet in a downwardly directed apex, and a substantially straight base edge having opposed extremities from which short angled edges extend downwardly to meet said side edges to form lateral apices, said base edge disposed opposite said downwardly directed apex in a manner causing said forward panel to have a line of symmetry that intersects said downwardly directed apex and perpendicularly bisects said base edge, 2) a back panel disposed upon the rear surface of said forward panel adjacent said base edge and formed as a continuous integral extension of said forward panel by virtue of the rearward folding of said piece of fabric, said back panel being disposed in parallel relationship to said forward panel and defining therewith a pocket region, and 3) elongated tying ears outwardly emergent from said lateral apices as continuous integral extensions of said forward panel and formed by the gathering and sewing of said piece of fabric, and b) a sheet of compliant thermally insulative material disposed within said pocket region and elongated upon a center axis parallel to said base edge and intersecting said lateral apices.

2. The article of wearing apparel of claim 1 wherein said integral piece of fabric is comprised of hydrophilic fiber.

3. The article of wearing apparel of claim 2 wherein said hydrophilic fiber is cotton.

4. The article of wearing apparel of claim 1 wherein the thermally insulative material is of rectangular configuration and is sewn within the pocket region by stitching that penetrates forward and back panels and the intervening insulative material.

5. The article of wearing apparel of claim 1 wherein said insulative material is comprised of cellular foam fabricated of a synthetic resilient polymer.

6. The article of wearing apparel of claim 5 wherein said resilient polymer is polyurethane.

* * * * *